US008266734B2

(12) United States Patent
Allard et al.

(10) Patent No.: US 8,266,734 B2
(45) Date of Patent: Sep. 18, 2012

(54) RETRACTABLE BIDET

(76) Inventors: Jules Allard, Boucherville (CA); Lucie Jacob, Boucherville (CA)

( * ) Notice: Subject to any disclaimer, the term of this patent is extended or adjusted under 35 U.S.C. 154(b) by 0 days.

(21) Appl. No.: 12/737,424

(22) PCT Filed: Jul. 17, 2009

(86) PCT No.: PCT/CA2009/001018

§ 371 (c)(1),
(2), (4) Date: Jan. 12, 2011

(87) PCT Pub. No.: WO2010/009545

PCT Pub. Date: Jan. 28, 2010

(65) Prior Publication Data

US 2011/0107507 A1 May 12, 2011

Related U.S. Application Data

(60) Provisional application No. 61/082,242, filed on Jul. 21, 2008.

(51) Int. Cl.
*E03D 9/08* (2006.01)

(52) U.S. Cl. ..... 4/420.4

(58) Field of Classification Search ..... 4/420.4, 4/420, 443–448, 300

See application file for complete search history.

(56) References Cited

U.S. PATENT DOCUMENTS

| | | | | |
|---|---|---|---|---|
| 1,521,892 | A * | 1/1925 | Koppin | 4/420.4 |
| 1,866,930 | A * | 7/1932 | Guidetti et al. | 4/420.2 |
| 4,998,300 | A | 3/1991 | Sharifzadeh | |
| 5,025,511 | A | 6/1991 | Takeda | |
| 5,272,774 | A | 12/1993 | Ivko | |
| 5,359,736 | A | 11/1994 | Olivier | |
| 5,953,765 | A | 9/1999 | Hayashi | |
| 6,073,275 | A | 6/2000 | Klopocinski | |

FOREIGN PATENT DOCUMENTS

| | | |
|---|---|---|
| WO | WO2006127505 | 11/2006 |
| WO | WO2006127505 A1 * | 11/2006 |
| WO | WO2006133521 | 12/2006 |

* cited by examiner

*Primary Examiner* — Lori Baker

(57) ABSTRACT

A bidet usable with a water source and mountable to a toilet. The toilet includes a toilet bowl, the toilet bowl defining a bowl inner surface and a waterline defined on the bowl inner surface at an operational level of water in the toilet bowl, the toilet bowl also defining a bowl aperture extending therethrough below the waterline. The bidet includes a piston defining a piston passageway extending therethrough, the piston passageway being couplable to the water source for receiving water therefrom, the piston defining a nozzle for releasing water from the piston passageway. The bidet is operatively mountable to the toilet with the piston extending through the bowl aperture and protruding in the toilet bowl. With the bidet operatively mounted to the toilet bowl, the piston is movable through the bowl aperture between a retracted position and an extended position, the nozzle being substantially adjacent to the bowl inner surface and below the waterline when the piston is in the retracted position and the nozzle being spaced apart from the bowl inner surface and above the waterline when the piston is in the extended position.

14 Claims, 4 Drawing Sheets

RETRACTABLE BIDET

This application claims priority from U.S. Patent Application No. 61/082,242 on Jul. 21, 2008.

FIELD OF THE INVENTION

The present invention relates generally to the field of personal hygiene and, more particularly, to a retractable bidet.

BACKGROUND

Bidets are used by many for personal hygiene. However, they take up valuable space in restrooms and are rather costly. To alleviate these problems, many bidets are integrated into toilets, either as an add-on kit, or at the time of manufacturing. In such a combination toilet and bidet, the bidet portion includes a tube that is either fixed in place in the toilet or, more commonly, movable so as to be out of the way when the toilet is used to dispose of bodily wastes, and to be movable at a suitable location when used for cleaning purposes.

By their nature and position, such tubes can relatively easily become soiled by bodily wastes. Because of their configuration, they are relatively difficult to clean thoroughly. Some prior art bidets are retractable from the toilet bowl through an aperture located substantially adjacent the upper edge of the toilet bowl. However, these bidets usually include a retraction and deployment mechanism that is rather costly and prone to malfunction.

Against this background, there exist a need for a new and improved bidet. It is a general object of the present invention to provide a new and improved bidet.

SUMMARY OF THE INVENTION

In a broad aspect, the invention provides a bidet usable with a water source and mountable to a toilet. The toilet includes a toilet bowl, the toilet bowl defining a bowl inner surface and a waterline defined on the bowl inner surface at an operational level of water in the toilet bowl, the toilet bowl also defining a bowl aperture extending therethrough below the waterline. The bidet includes a piston defining a piston passageway extending therethrough, the piston passageway being couplable to the water source for receiving water therefrom, the piston defining a nozzle for releasing water from the piston passageway. The bidet is operatively mountable to the toilet with the piston extending through the bowl aperture and protruding in the toilet bowl. With the bidet operatively mounted to the toilet bowl, the piston is movable through the bowl aperture between a retracted position and an extended position, the nozzle being substantially adjacent to the bowl inner surface and below the waterline when the piston is in the retracted position and the nozzle being spaced apart from the bowl inner surface and above the waterline when the piston is in the extended position.

The waterline is defined at an operational level of water in the toilet bowl. This operational level of water corresponds to a level of water in the toilet bowl when the toilet is used in a conventional manner to receive bodily wastes that are to be flushed from the toilet bowl in a conventional manner. Typically, the toilet bowl is in fluid communication with a siphon that is used to flush the toilet bowl when water is added to the toilet bowl until the siphon is filled, at which point the water contained in the toilet bowl is siphoned out of the toilet bowl. The operational level of water then corresponds to a level of water in which the siphon is partially filled with water.

Advantageously, the proposed bidet is at relatively low risk of becoming soiled when in the retracted configuration as only a small part of the nozzle protrudes into the toilet bowl at a location that is below the waterline. In any case, if the nozzle becomes soiled, movements of water in the toilet bowl when the toilet is flushed have a natural cleaning effect, as has the projection of water from the nozzle when the bidet is used. Furthermore, as the piston retracts towards the retracted position, some of the water remaining in the bidets is pushed out of the nozzle, which provides further cleaning action.

The proposed bidet includes a piston that is moved between the extended and retracted positions using water pressure present naturally in household water pipes. No outside motors or similar mechanisms are required. This results in a relatively robust design that is manufactured at relatively low costs.

The proposed bidet is also relatively easily usable, even by people with reduced mobility, which represent a relatively large class of bidet users.

In some embodiments of the invention, the proposed bidet is retrofitable to an existing toilet. In alternative embodiments of the invention, the proposed bidet is integrated to a toilet at the moment of manufacturing.

In another broad aspect, the invention provides a toilet usable with a water source. The toilet includes a toilet bowl defining a bowl water inlet couplable to the water source for selectively admitting water into the toilet bowl; a bowl water outlet for selectively evacuating water from the toilet bowl; a bowl inner surface; and a waterline defined on the bowl inner surface at an operational level of water in the toilet bowl. The toilet also includes a bidet, the bidet including a piston defining a piston passageway extending therethrough, the piston passageway being couplable to the water source for receiving water therefrom, the piston defining a nozzle for releasing water from the piston passageway, the piston protruding in the toilet bowl through the bowl inner surface. The piston is movable between a retracted position and an extended position, the nozzle being substantially adjacent to the bowl inner surface and below the waterline when the piston is in the retracted position and the nozzle being spaced apart from the bowl inner surface and above the waterline when the piston is in the extended position.

In yet another broad aspect, the invention provides a method for cleaning body parts while seated on a toilet bowl using water projected through a nozzle, the toilet bowl defining a waterline at an operational water level in the toilet bowl. The method includes raising the nozzle above the waterline; projecting the water on the body parts through the nozzle; stopping a flow of the water through the nozzle; and lowering the nozzle below the waterline.

Other objects, advantages and features of the present invention will become more apparent upon reading of the following non-restrictive description of preferred embodiments thereof, given by way of example only with reference to the accompanying drawings.

DETAILED DESCRIPTION

Figure 1:
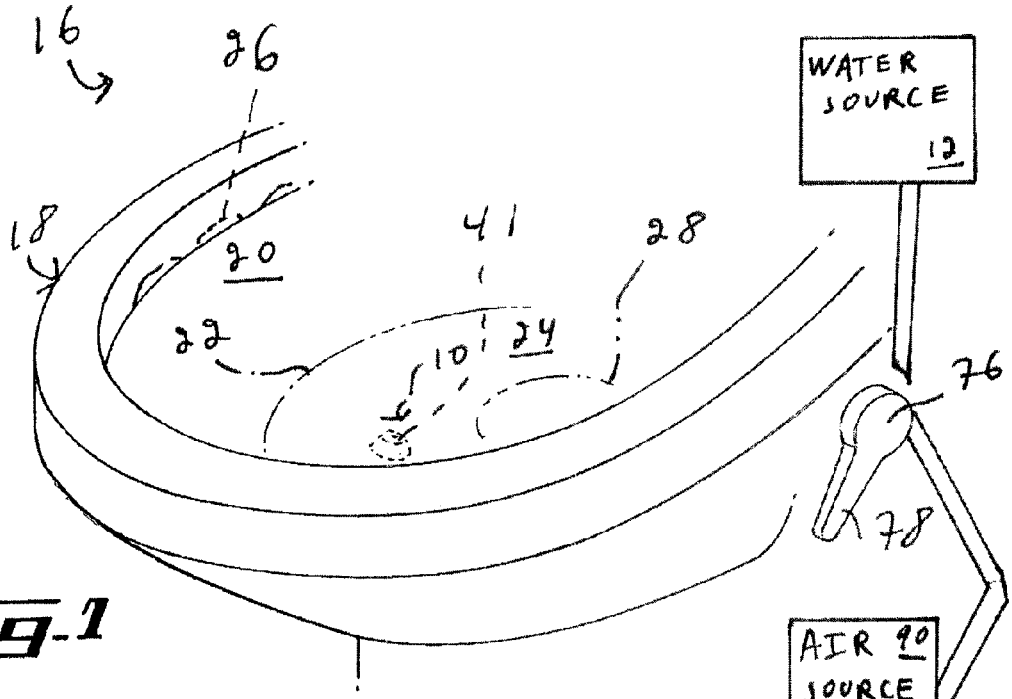
FIG. 1, in a perspective view, illustrates a bidet according to an embodiment of the present invention, the bidet being shown attached to a toilet bowl, the bidet including a piston, the piston being shown in a retracted position.

FIGS. 1 to 5 illustrate a bidet 10 usable with a water source 12 and mountable to a toilet 16. The water source 12 is any suitable water source, such as domestic water pipes commonly found in houses. The toilet 16 is a conventional toilet that includes a toilet bowl 18. The toilet bowl 18 defines a bowl inner surface 20 and a waterline 22 defined on the bowl inner surface 20 at an operational level of water 24 in the toilet bowl 18. The toilet bowl 18 also define a conventional bowl water inlet 26 in fluid communication with the water source 12 for selectively admitting water 24 into the toilet bowl 18 and a conventional bowl water outlet 28 for selectively evacuating water 24 from the toilet bowl 18. As better seen in FIGS. 3 and 4, the toilet bowl 18 also defines a bowl aperture 30 extending therethrough below the waterline 22. The bowl aperture 30 is either manufactured along with the remainder of the toilet bowl 18, or is drilled through the toilet bowl 18 so as to retrofit the bidet 10 to an existing toilet 16.

Figure 5:
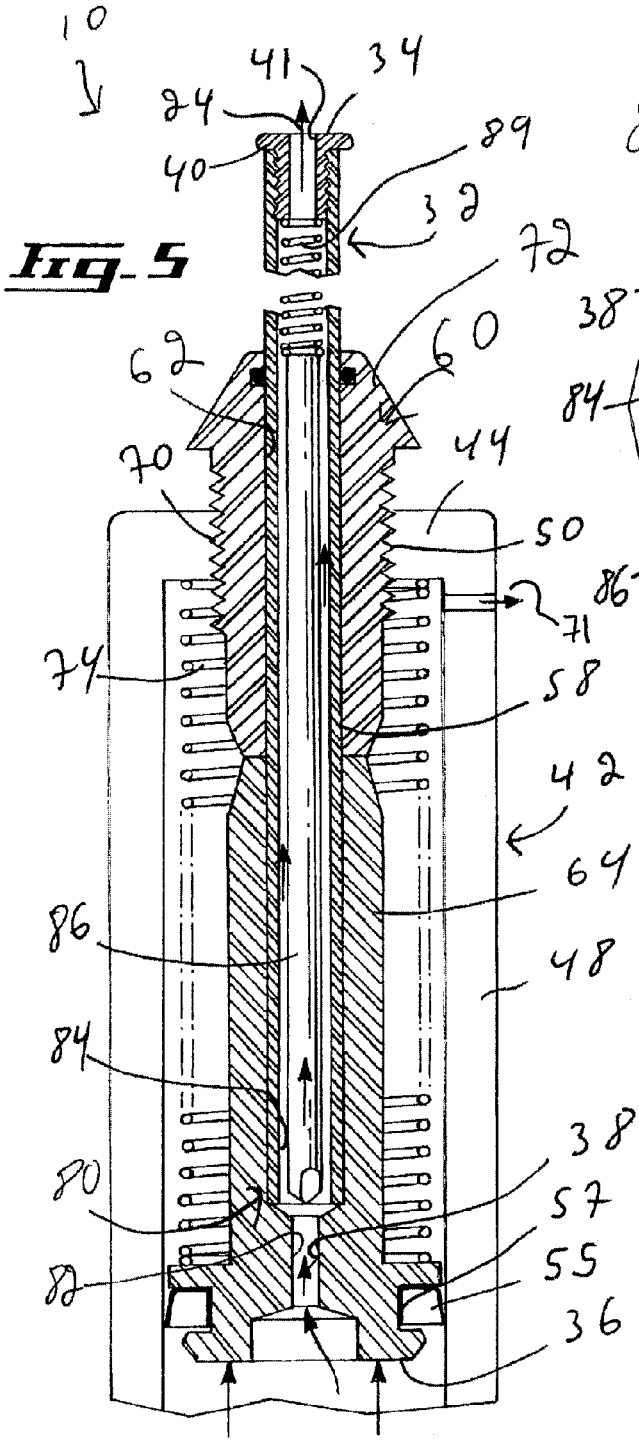
FIG. 5, in a side cross-sectional view, illustrates the bidet shown in FIGS. 1 to 4.

The bidet 10 includes a piston 32 defining a piston proximal end 34 and a substantially longitudinally opposed piston distal end 36. As seen in FIG. 5, the piston 32 defines a piston passageway 38 extending therethrough, for example between the piston proximal and distal ends 34 and 36. The piston passageway 38 is couplable to the water source 12 for receiving water 24 therefrom. The piston 32 also defines a nozzle 40, typically substantially adjacent the piston distal end 36, for releasing water 24 from the piston passageway 38. As seen in FIGS. 1 to 4, in some embodiments of the invention, the nozzle 40 includes a single nozzle aperture 41 located at the piston proximal end 34 for releasing the water 24.

Figure 2:
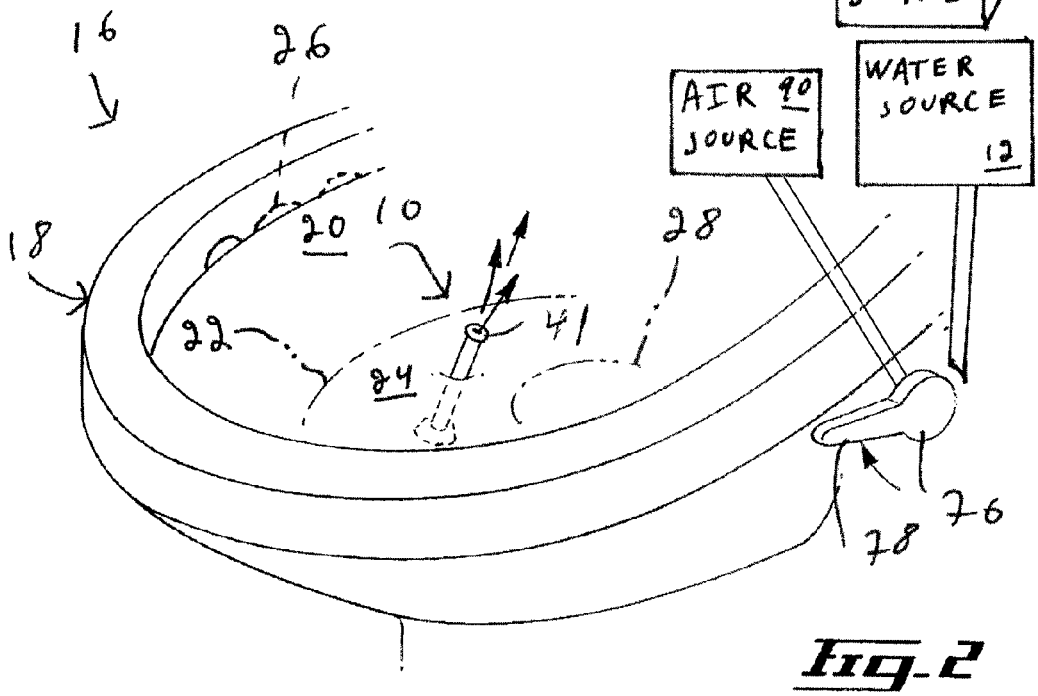
FIG. 2, in a perspective view, illustrates the bidet shown in FIG. 1 with the piston thereof shown in an extended position.
Figure 3:
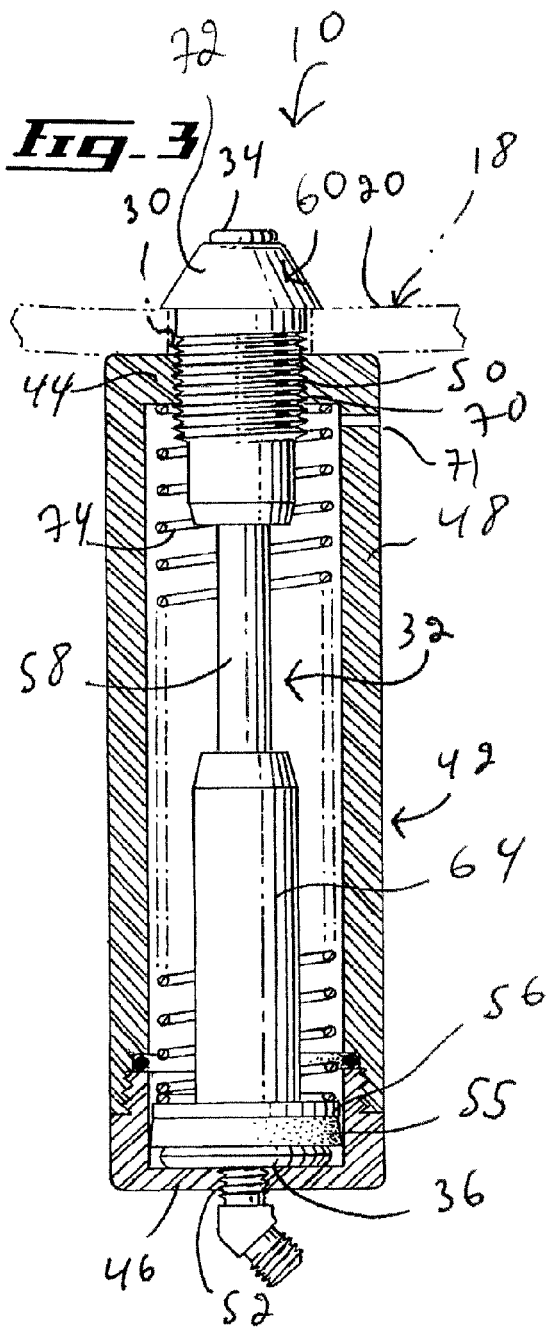
FIG. 3, in a side elevation view with parts removed, illustrates the bidet shown in FIGS. 1 and 2 with the piston thereof shown in the retracted position.
Figure 4:
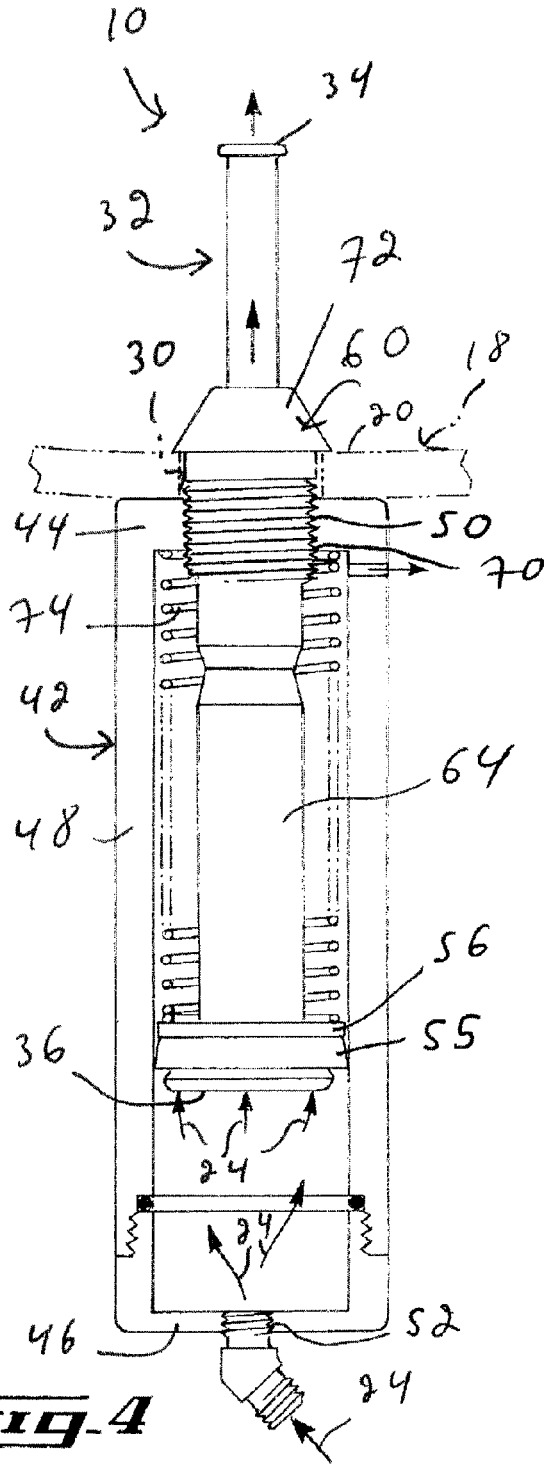
FIG. 4, in a side elevation view with parts removed, illustrates the bidet shown in FIGS. 1 to 3 with the piston thereof shown in the extended position.

The bidet 10 is operatively mounted to the toilet 16 with the piston 32 extending through the bowl aperture 30 and protruding in the toilet bowl 18. The piston 32 is movable through the bowl aperture 30 between a retracted position (seen for example in FIGS. 1 and 3) and an extended position (seen for example in FIGS. 2 and 4). As seen in FIG. 1, the nozzle 40 is substantially adjacent to the bowl inner surface 20 and below the waterline 22 when the piston 32 is in the retracted position, and, as seen in FIG. 2, the nozzle 40 is spaced apart from the bowl inner surface 20 and above the waterline 22 when the piston 32 is in the extended position.

Returning to FIGS. 3 and 4, typically, the bidet 10 also includes a cylinder 42 mounted to the toilet bowl 18. The piston 32 is slidably mounted in the cylinder 42 so as to be movable therealong. Typically, the cylinder 42 has a substantially cylindrical configuration with substantially circular transversal cross-section. However, in alternative embodiments of the invention, the cylinder 42 has any other suitable cross-sectional configuration.

More specifically, the cylinder 42 defines a cylinder proximal end wall 44, a substantially opposed cylinder distal end wall 46 and a cylinder peripheral wall 48 extending therebetween. The cylinder proximal end wall 44 is located substantially adjacent to the bowl aperture 30 when the bidet 10 is operatively mounted to the toilet bowl 18. Typically, a portion of the cylinder 42 including the cylinder proximal end wall 44 is removably attached to the remainder of the cylinder 42 for maintenance and assembly purposes.

A cylinder outlet 50 extends through the cylinder proximal end wall 44. The cylinder outlet 50 is substantially in register with the bowl aperture 30. The piston 32 protrudes from the cylinder outlet 50. The cylinder 42 also defined a cylinder inlet 52 couplable to the water source 12. Typically, the cylinder inlet 52 extends through the cylinder distal end wall 46, but other configurations are within the scope of the present invention.

The piston 32 substantially sealingly engages the cylinder peripheral wall 48 between the cylinder inlet and outlet 52 and 50. To that effect, in some embodiments of the invention, the piston 32 is provided with a substantially annular rubber ring 55 that extends at the periphery thereof at the junction between the piston 32 and the cylinder peripheral wall 48. The rubber ring 55 is typically slightly compressed against the cylinder peripheral wall 48, which provide the seal between the cylinder peripheral wall 48 and the rubber ring 55.

More specifically, the piston 32 defines a piston base 56 having a substantially plate shaped configuration and defining a substantially annular groove 57, better seen in FIG. 5, for receiving the rubber ring 55 thereinto. The piston base 56 therefore engages the cylinder peripheral wall 48. A piston tube 58 extends from the piston base 56 substantially perpendicularly thereto. The piston tube 58 protrudes through the cylinder outlet 50. The nozzle 40 is provided on the piston tube 58 substantially opposed to the piston base 56. The piston passageway 38 extends through the piston tube 58 and the piston base 56, and the piston passageway 38 is therefore fluid communication with the cylinder inlet 52.

In some embodiments of the invention, the cylinder 42 is provided with a plug 60 extending through the cylinder outlet 50. The plug 60 defines a plug passageway 62 extending therethrough and protrudes both proximally and distally from the cylinder outlet 50. The piston tube 58 extends through the plug passageway 62 and is typically substantially snugly fitted thereto while remaining substantially easily slidable therealong.

The plug 60 is provided for facilitating installation of the bidet 10 to the toilet 16, as well as for limiting movements of the piston 32 relatively to the cylinder 42. To that effect, the piston tube 58 defines a piston flange 64 extending substantially radially outwardly therefrom at a location intermediate the piston base 56 and the plug 60. Movement of the piston 32 toward the extended position is stopped when the piston flange 64 abuts against the plug 60. An advantage provided by this configuration resides in ease of adapting the bidet 10 to toilets 16 of different configurations by selecting pistons 32 and plugs 60 having dimensions such that the nozzle 40 is at a suitable distance from the bowl inner surface 20 when in the extended configuration.

Ease of installation and removal of the bidet 10 is provided when removal of the plug 60 from the remainder of the cylinder 42 is ensured by having a threaded plug 60 that engages corresponding threads 70 provided in the cylinder proximal end wall 44. The plug 60 typically defines a plug flange 72 that extends radially outwardly over a larger radius than the bowl aperture 30 and that is positioned inside the toilet bowl 18 such that the cylinder 42 is pressed against the toilet bowl 18 by the plug flange 72. Typically, the plug flange 72 has a substantially frusto-conical shape that tapers in a direction leading away from the bowl inner surface 20 to facilitate natural cleaning of the plug flange 72 by natural water circulation in the toilet 16 during normal use. In this configuration, the bidet 10 is removably attached to the toilet bowl 18.

A venting aperture 71 is provided in the cylinder peripheral wall 48 between the piston base 56 and the cylinder proximal end wall 44. This facilitates movements of air in and out of the volume defined by the cylinder peripheral wall 48, the piston base 56 and the cylinder proximal end wall 44 so that the piston 32 moves relatively easily along the cylinder 42.

In some embodiments of the invention, movement of the piston 32 toward the retracted position occurs through to the action of gravity when no water is provided to the piston 32. In other embodiments of the invention, a biasing element 74 is operatively coupled to the piston 32 for biasing the piston 32 toward the retracted position. To that effect, in some embodiments of the invention, the biasing element 74 takes the form of a coil spring that extends between the cylinder proximal end wall 44 and the piston base 56.

Returning to FIGS. 1 and 2, in some embodiments of the invention, a main valve 76 is provided between the water source 12 and the nozzle 40 for controlling a flow of water 24 between the water source 12 and the nozzle 40. The main valve 76 is provided with a handle 78 protruding outside of the toilet bowl 18 for selectively allowing opening and closing of the main valve 76 in a conventional manner. However, in alternative embodiments of the invention, control of the flow of water 24 toward the piston 32 is effected in any other suitable manner.

Figure 6:
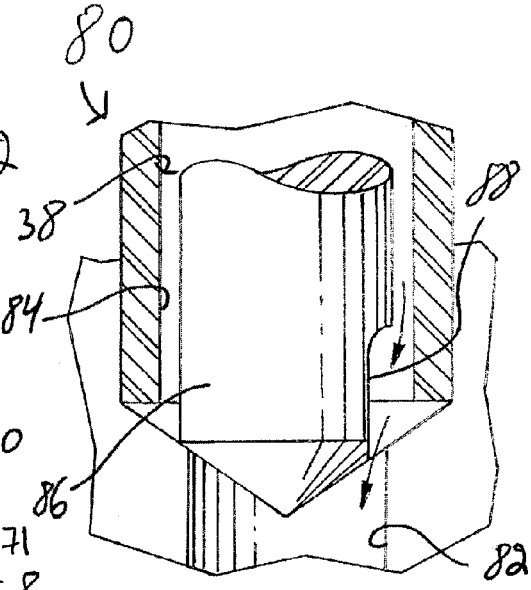
FIG. 6, in a side cross-sectional view with parts removed, illustrates an auxiliary valve part of the piston of the bidet shown in FIGS. 1 to 5, the auxiliary valve being shown in a closed configuration.

Referring to FIGS. 5 and 6, in some embodiments of the invention, the piston 32 is provided with an auxiliary valve 80 for selectively allowing water flow through the piston passageway 38. For example, the auxiliary valve 80 is a pressure actuated valve opening only when a water pressure differential across the piston passageway 38 is larger than a predetermined pressure threshold. The auxiliary valve 80 is operable between an open configuration, shown in FIG. 5, and a closed configuration, shown in FIG. 6.

To that effect, the piston passageway 38 defines a passageway first section 82 and a passageway second section 84 extending therefrom. The passageway first section 82 extends from the piston base 56 toward the nozzle 40. The passageway second section 84 extends between the passageway first section 82 and the nozzle 40. The passageway first section 82 has a diameter smaller than the diameter of the passageway second section 84.

A rod 86 is provided in the passageway second section 84. The rod 86 has a length smaller than the length of the passageway second section 84 and is substantially longitudinally movable therealong. The rod 86 has a diameter larger than the passageway first section 82. A biasing element, such as a coil spring 89, seen in FIG. 5 only, is provided between the rod 86 and the nozzle 40. The coil spring 89 biases the rod 86 toward the passageway first section 82. Therefore, by default, the rod 86 abuts against the passageway first section 82 and substantially obstructs the flow of water toward the nozzle 40. The auxiliary valve 80 is then in the closed configuration.

When a predetermined force is exerted on the rod 86, corresponding to the predetermined pressure threshold mentioned hereinabove, the rod 86 moves toward the nozzle 40 and flow of water to the passageway second section 84 is allowed. The auxiliary valve 80 is then in the opened configuration.

In some embodiments of the invention, as better seen in FIG. 6 the rod 86 is provided with a notch 88 located substantially adjacent to the passageway first section 82 in the closed configuration for allowing backflow of water 24 toward the passageway first section 82 from the passageway second section 84 when little or no water pressure is provided in the passageway first section 82. However, the notch 88 is typically too small to allow any significant flow of water 24 toward the nozzle 40 when little or no water pressure is provided by the water source 12.

Figure 8:
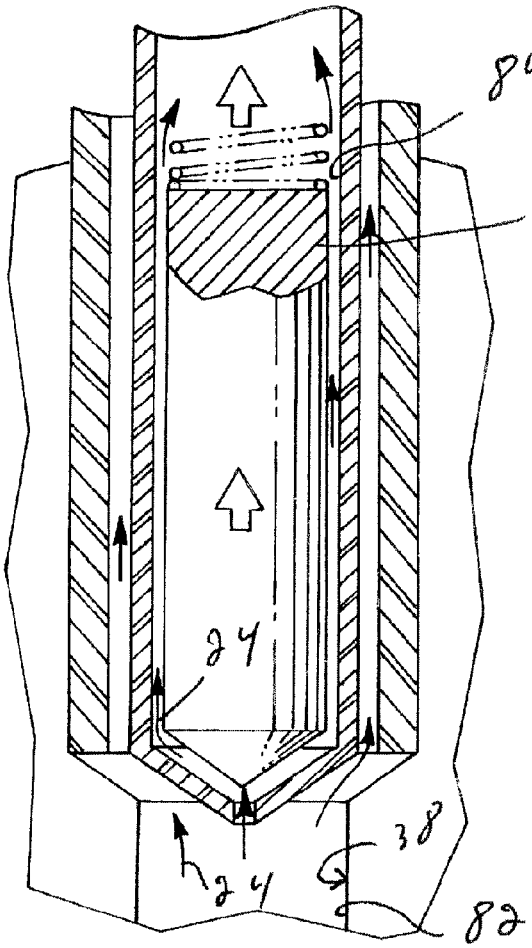
FIG. 8, in a side cross-sectional view with parts removed, illustrates an alternative auxiliary valve part of the piston of the bidet shown in FIGS. 1 to 5, the alternative auxiliary valve being shown in an open configuration.
Figure 9:
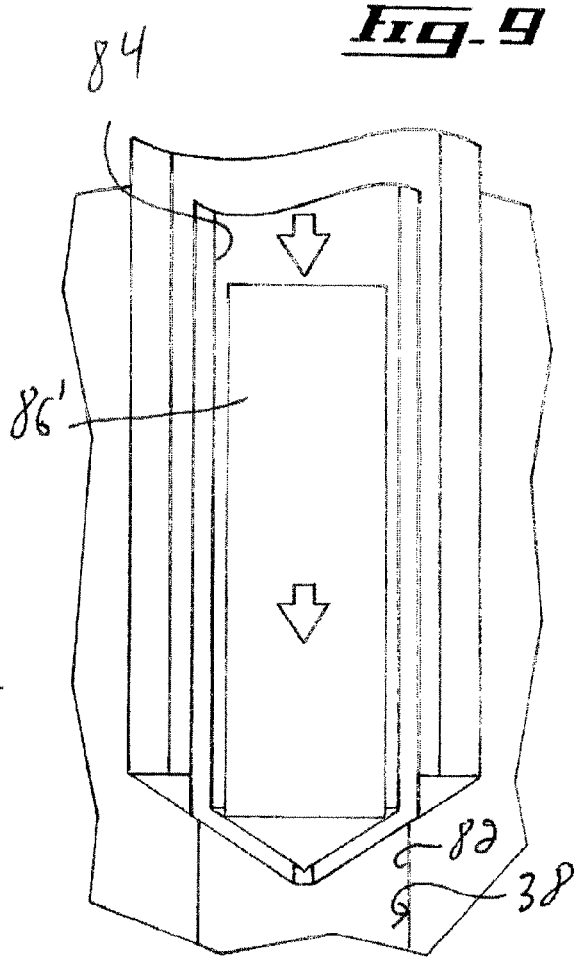
FIG. 9, in a side cross-sectional view with parts removed, illustrates the alternative auxiliary valve shown in FIG. 8, the alternative auxiliary valve being shown in a closed configuration.

In alternative embodiments of the invention, as seen in FIGS. 8 and 9, a rod 86' is provided that is deprived from the notch 88 and which therefore substantially entirely obstructs the passageway first section 82 when the auxiliary valve 80 is in the closed configuration, as shown in FIG. 9. When in an opened configuration, flow of water 24 is allowed, as seen in FIG. 8. In these embodiments, backflow of water towards the water source 12 is prevented in the closed configuration, which prevents flow of fecal matter or other bodily wastes towards the water source 12.

Figure 7:
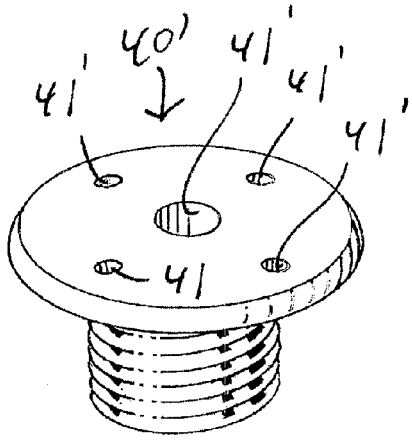
FIG. 7, in a perspective view, illustrates a nozzle usable with the bidet shown in FIGS. 1 to 6.

FIG. 7 illustrates an alternative nozzle 40' usable to replace the nozzle 40 shown in FIGS. 1 to 5. The alternative nozzle 40' includes five nozzle apertures 41' usable for spaying a larger area of the body of an intended user of the bidet 10. In some embodiments of the invention, the nozzles 40 and 40' are removably fitted to the piston tube 58 and relatively easily removable therefrom so as to be exchanged. This fit can be made through a tight fit or through the use of threads, or to any other manner known in the art.

As seen in FIG. 1, optionally, the bidet 10 includes a conventional air source 90 operatively coupled to the piston 32 for selectively providing air to the nozzle 40.

In use, the main valve 76 is opened using the handle 78, which allows water 24 to flow from the water source 12 toward the nozzle 40. When the water 24 enters the cylinder 42, pressure is built into the cylinder 42 between the cylinder distal end wall 54 and the piston base 56, which causes movement of the piston 32 toward the extended configuration and raises the nozzle 40 above the waterline 22. This movement of the piston 32 compresses the biasing element 74. The water pressure also opens the auxiliary valve 80. The water 24 is then projected on the body parts to wash through the nozzle 40.

Afterwards, when the intended users wishes to stop the flow of water 24 to the nozzle 40, the intended user simply uses the handle 78 to close the main valve 76. Since the main valve 76 is closed, water pressure from the water source 12 no one longer reaches the cylinder 42, which has for effect to stop the flow of water through the nozzle 40 and allow the biasing element 74 to push back the piston 32 toward the retracted position and below the waterline 22. As this occurs, water 24 residing in the cylinder 42 between the piston base 56 and the cylinder distal end wall 54 is pushed out of the nozzle 40, which produces a self-cleaning action. Withdrawal of water pressure from the cylinder 42 also eventually leads the auxiliary valve 80 to reach the closed configuration.

Although the present invention has been described hereinabove by way of preferred embodiments thereof, it can be modified, without departing from the spirit and nature of the subject invention as defined in the appended claims.

What is claimed is:

1. A bidet usable with a water source and mountable to a toilet, said toilet including a toilet bowl, said toilet bowl defining a bowl inner surface and a waterline defined on said bowl inner surface at an operational level of water in said toilet bowl, said toilet bowl also defining a bowl aperture extending therethrough below said waterline, said bidet comprising:

a piston defining a piston passageway extending therethrough, said piston passageway being couplable to said water source for receiving water therefrom, said piston defining a nozzle for releasing water from said piston passageway;

said bidet being operatively mountable to said toilet with said piston extending through said bowl aperture and protruding in said toilet bowl, wherein, with said bidet operatively mounted to said toilet bowl, said piston is movable through said bowl aperture between a retracted position and an extended position, said nozzle being substantially adjacent to said bowl inner surface and below said waterline when said piston is in said retracted position and said nozzle being spaced apart from said bowl inner surface and above said waterline when said piston is in said extended position.

2. A bidet as defined in claim 1, further comprising a cylinder mounted to said toilet bowl, said piston being slidably mounted in said cylinder so as to be movable therealong.

3. A bidet as defined in claim 2, wherein said cylinder defines a cylinder proximal end wall, a substantially opposed cylinder distal end wall and a cylinder peripheral wall extending therebetween, said cylinder proximal end wall being located substantially adjacent to said bowl aperture when said bidet is operatively mounted to said toilet bowl;

a cylinder outlet extending through said cylinder proximal end wall, said cylinder outlet being substantially in register with said bowl aperture when said bidet is operatively mounted to said toilet bowl, said piston protruding from said cylinder outlet; and a cylinder inlet couplable to said water source;

said piston substantially sealingly engaging said cylinder peripheral wall between said cylinder inlet and outlet;

said piston passageway being in fluid communication with said cylinder inlet.

4. A bidet as defined in claim 3, wherein said cylinder inlet extends through said cylinder distal end wall.

5. A bidet as defined in claim 3, wherein said piston defines a piston base engaging said cylinder peripheral wall and a piston tube extending from said piston base, said piston tube protruding from said cylinder through said cylinder outlet, said nozzle being provided on said piston tube substantially opposed to said piston base.

6. A bidet as defined in claim 5, wherein said cylinder is provided with a plug extending through said cylinder outlet, said plug defining a plug passageway extending therethrough, said piston tube extending through said plug passageway; and said piston tube defines a piston flange extending substantially radially outwardly therefrom at a location intermediate said piston base and said plug;

whereby movement of said piston toward said extended position is stopped when said piston flange abuts against said plug.

7. A bidet as defined in claim 2, wherein said cylinder is removably attached to said toilet bowl.

8. A bidet as defined in claim 1, further comprising a biasing element operatively coupled to said piston for biasing said piston toward said retracted position.

9. A bidet as defined in claim 1, wherein said bidet includes an air source operatively coupled to said piston for selectively providing air to said nozzle.

10. A bidet as defined in claim 1, wherein said piston is provided with an auxiliary valve for selectively allowing water flow through said piston passageway.

11. A bidet as defined in claim 10, wherein said auxiliary valve is a pressure actuated valve opening only when a water pressure differential across said piston passageway is larger than a predetermined pressure threshold.

12. A bidet as defined in claim 1, further comprising a main valve provided between said water source and said nozzle for controlling a flow of water between said water source and said nozzle.

13. A bidet as defined in claim 12, wherein said main valve is provided with a handle protruding outside of said toilet bowl for selectively allowing opening and closing of said main valve.

14. A toilet usable with a water source, said toilet comprising:

a toilet bowl, said toilet bowl defining;

a bowl water inlet in fluid communication with said water source for selectively admitting water into said toilet bowl;

a bowl water outlet for selectively evacuating water from said toilet bowl;

a bowl inner surface; and a waterline defined on said bowl inner surface at an operational level of water in said toilet bowl; and a bidet, said bidet including a piston defining a piston passageway extending therethrough, said piston passageway being couplable to said water source for receiving water therefrom, said piston defining a nozzle for releasing water from said piston passageway, said piston protruding in said toilet bowl through said bowl inner surface;

wherein said piston is movable between a retracted position and an extended position, said nozzle being substantially adjacent to said bowl inner surface and below said waterline when said piston is in said retracted position and said nozzle being spaced apart from said bowl inner surface and above said waterline when said piston is in said extended position.

* * * * *